United States Patent [19]

Kirt

[11] Patent Number: 4,625,465

[45] Date of Patent: Dec. 2, 1986

[54] HONE STOP ASSEMBLY

[76] Inventor: Daryl L. Kirt, Rte. 4, Box 276A, Pierz, Minn. 56364

[21] Appl. No.: 811,156

[22] Filed: Dec. 19, 1985

[51] Int. Cl.[4] ..... B24B 55/00

[52] U.S. Cl. ..... 51/262 R; 51/241 R; 51/245; 51/34 R; 51/290; 29/156.4 WL; 408/241 S; 408/709; 409/218

[58] Field of Search ..... 51/262 R, 241 R, 245, 51/34 R, 290; 29/156.4 WL; 408/241 S, 708, 709; 409/218

[56] References Cited

U.S. PATENT DOCUMENTS

| | | | |
|---|---|---|---|
| 1,375,839 | 4/1921 | Callemore | 408/709 |
| 1,848,725 | 3/1932 | Johnson | 408/709 |
| 2,521,210 | 9/1950 | Fulmer | 51/245 |

FOREIGN PATENT DOCUMENTS

| | | | |
|---|---|---|---|
| M 2741 | 1/1955 | Fed. Rep. of Germany | 51/34 R |

*Primary Examiner*—Harold D. Whitehead
*Attorney, Agent, or Firm*—Gregory P. Kaihoi

[57] ABSTRACT

A hone stop assembly for use with a honing tool in reconditioning the cylinder bores of an internal combustion engine block. The assembly includes a frame mountable to an engine block, a disk-shaped hone stop, and suitable adjustable connections from the hone stop to the frame to allow the stop to be selectively positioned adjacent to an end of a cylinder bore. A honing tool inserted from the other end of the cylinder bore will contact the hone stop rather than any engine castings adjacent to the end of the cylinder, preventing damage to the honing stones and facilitating accurate reconditioning of the cylinder walls while reducing the tendency of the mechanic to taper the cylinder walls.

11 Claims, 4 Drawing Figures

HONE STOP ASSEMBLY

TECHNICAL FIELD

This invention is in the field of mechanical tools and equipment used in the manufacture or rebuilding of internal combustion engines, and in particular to a hone stop assembly useful in the process of honing the the cylinder bores of an engine block.

BACKGROUND ART

After a period of use, internal combustion engines frequently require substantial overhauling and rebuilding to correct problems resulting from cylinder wear, glazing, and other conditions causing improper tolerances between the piston rings and cylinder walls. These conditions can be corrected during overhaul of an engine by using appropriate honing, glaze-breaking, or similar tools to recondition the cylinder walls.

Large machine shops may utilize rather expensive boring machines to precisely recondition cylinder walls. Such machines are very costly, however, and beyond the means of many smaller garages and "backyard mechanics" who therefore must turn to less expensive alternatives. One popular alternative is the use of a honing tool which can be inserted into the chuck of a conventional hand-held electric drill. Such honing tools have been designed to include, for example, four honing stones mounted on a frame which resiliently urges the honing stones outwardly to engage the cylinder wall. Such devices accommodate the reasonable variations in the angle at which the drill is being held with respect to the cylinder axis, thereby producing a consistent and substantially true cylindrical shape for the new cylinder wall.

Use of such hand tools, however, produces problems of its own. Although the hand held honing tool is substantially cheaper than expensive automated machinery, the cost of such a tool is not insignificant and certainly the honing stones are not disposable. A mechanic must therefore be careful when using the tool in the cylinder bore not to extend the tool beyond the opposite end of the cylinder bore. Frequently there are metal castings closely within the area just beyond the end of the cylinder bores of an engine block, and if the honing stones come into contact with such metal castings or protrusions, the stones may be easily damaged or destroyed. In many engines, such protrusions are very close to the end of the cylinder, for example, within the range of about one-half inch to two inches beyond the end of the cylinder bore.

It is frequently difficult for the mechanic to view these protrusions during operation of the honing device. To avoid the rather expensive consequence of ruining the honing stones, mechanics therefore tend to shy away from the opposite end of the cylinder, effectively producing a tapered cylinder wall. The taper often may be in the range of 0.005–0.008 inches (0.15–0.20 mm). A taper of this dimension will cause a substantial detrimental effect on the fit of the rings, reducing compression and causing oil blow-by. An engine having cylinders with a taper in the range of 0.005–0.008 inches, for example, may use about one quart of oil every 1,000 miles, and may have a loss in gas mileage of approximately 1–3 miles per gallon. Furthermore, the loss of compression and oil blow-by contribute to pollution of the environment by increasing exhaust emissions.

DISCLOSURE OF INVENTION

The invention provides a hone stop assembly for use with a honing tool in honing the cylinder bores of an internal combustion engine block. The device is particularly useful in connection with an engine block of the type having a plurality of cylinder bores with first and second ends, the block further including projections adjacent the first end of at least one of said bores. The hone stop assembly includes a frame mountable to the engine block, a hone stop, and adjustment means for adjustably securing the hone stop to the frame and allowing the hone stop to be selectively positioned proximal to the first end of a cylinder bore. The hone stop prevents a honing tool, inserted from the second end of the cylinder bore, from contacting projections adjacent said cylinder bore first end to prevent damage to the honing stones. Use of such a hone stop assembly allows a mechanic to spend an equal amount of time honing all portions of the cylinder walls without any danger of damage to the honing stones.

Preferably the frame of the assembly includes a longitudinal shaft oriented lengthwise of the engine block, the shaft carrying the adjustment means and allowing selective adjustments of the hone stop adjacent to the first end of each of said cylinder bores without removing the frame from the engine block. The hone stop desirably comprises a circular disk having an axis, the disk being carried by a hone stop shaft having a longitudinal axis, the shaft being normal to the plane of the hone stop and coaxial therewith. Preferably the adjustment means comprises two perpendicular collars, the first of which adjustably receives therethrough the longitudinal frame shaft, and the second of which receives therethrough the hone stop shaft.

BEST MODE FOR CARRYING OUT THE INVENTION

Figure 1:
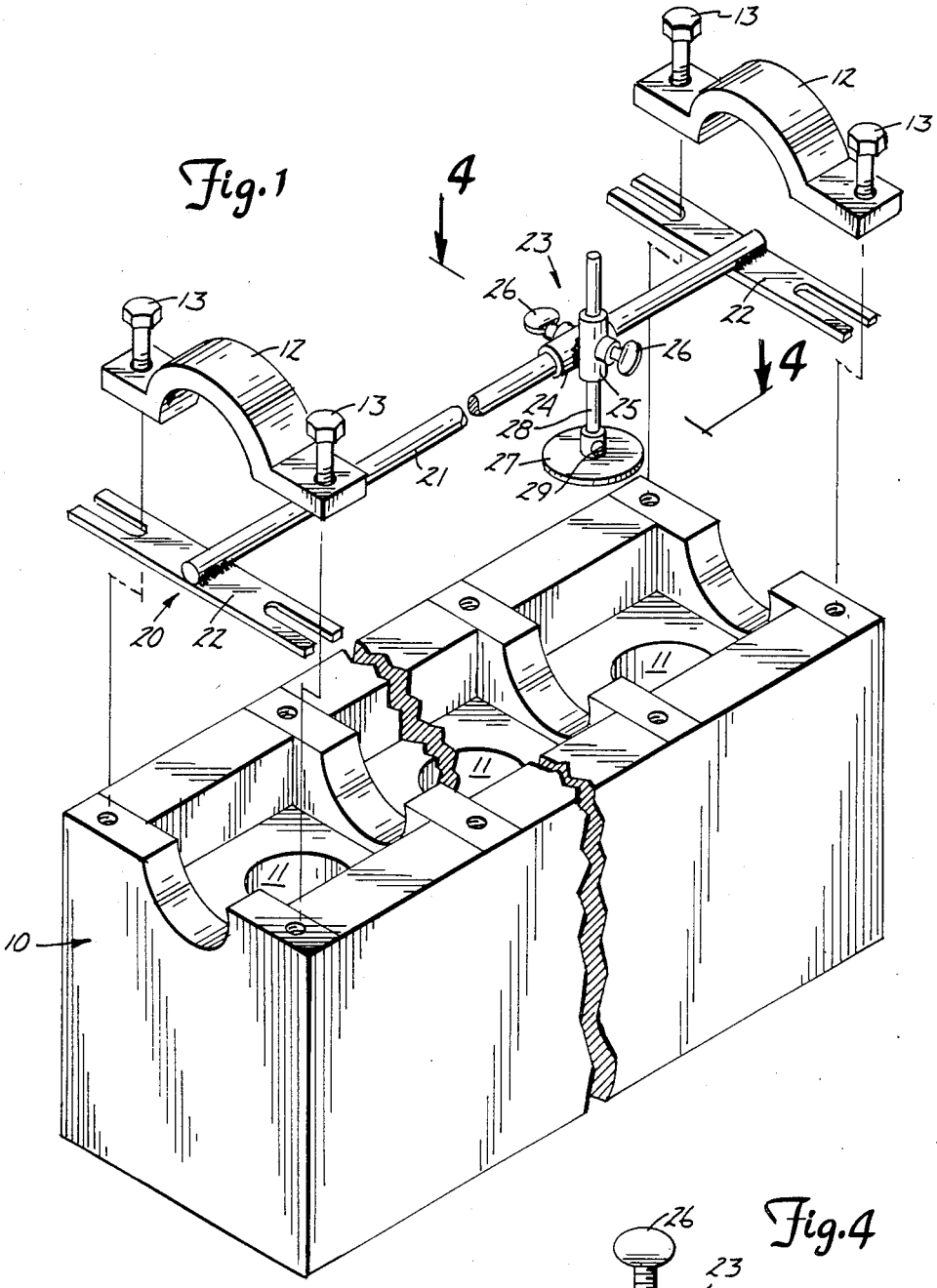
FIG. 1 is a perspective, partially exploded view of an engine block (shown somewhat schematically) with the hone stop assembly of the invention.
Figure 4:
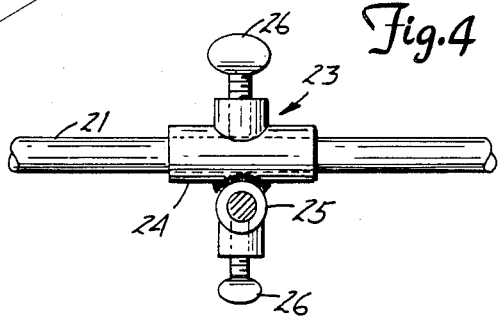
FIG. 4 is a broken-away cross-section of the hone stop assembly of FIG. 1 taken along line 4—4 thereof.

Referring to FIG. 1, the block of an internal combustion engine is shown schematically as (10). Although the engine block (10) shown is most representative of either a four cylinder or straight-six cylinder engine, it will be understood that the device of the invention functions equally well on V-8 and other engine designs as well. The engine block (10) is shown with the crankshaft removed, exposing the ends of the cylinder bores (11).

A hone stop assembly shown generally as (20) includes a frame which is mountable to the engine block (10). Preferably this frame comprises a longitudinal shaft (21) attached to a pair of anchoring straps (22). Although the anchoring straps (22) might be configured so as to attach to a variety of locations on the engine block, the straps (22) conveniently are secured to the engine block (10) by the crankshaft cap screws (13).

Although the crankshaft caps (12) are shown in the drawings as retaining the anchoring straps (22), the caps (12) are not necessary and the straps (22) can be attached to the block (10) directly by the bolts (13). Although the frame of the hone stop assembly might be configured so as to mount the anchoring straps (22) to any of the crankshaft cap positions, desirably they are attached to the two end positions, as shown in the drawings.

The hone stop assembly (20) further includes a hone stop disk (27) carried by a hone stop shaft (28). The shaft (28) and disk (27) may be attached by any conventional means, but preferably are attached by means of a set screw (29). The hone stop shaft (28) in turn is carried by adjustment means (23) for allowing the hone stop disk (27) to be selectively positioned adjacent the end of any one of the cylinder bores (11).

In a preferred embodiment, the adjustment means comprises a pair of collars (24) and (25) attached by welding or other suitable means in a perpendicular fashion. One of the collars (24) slidably and rotatably receives therethrough the longitudinal shaft (21). The second collar (25) slidably and rotatably receives therethrough the hone stop shaft (28). Each of the collars includes a wing nut (26) for securing the collar with respect to its respective shaft.

Figure 2:
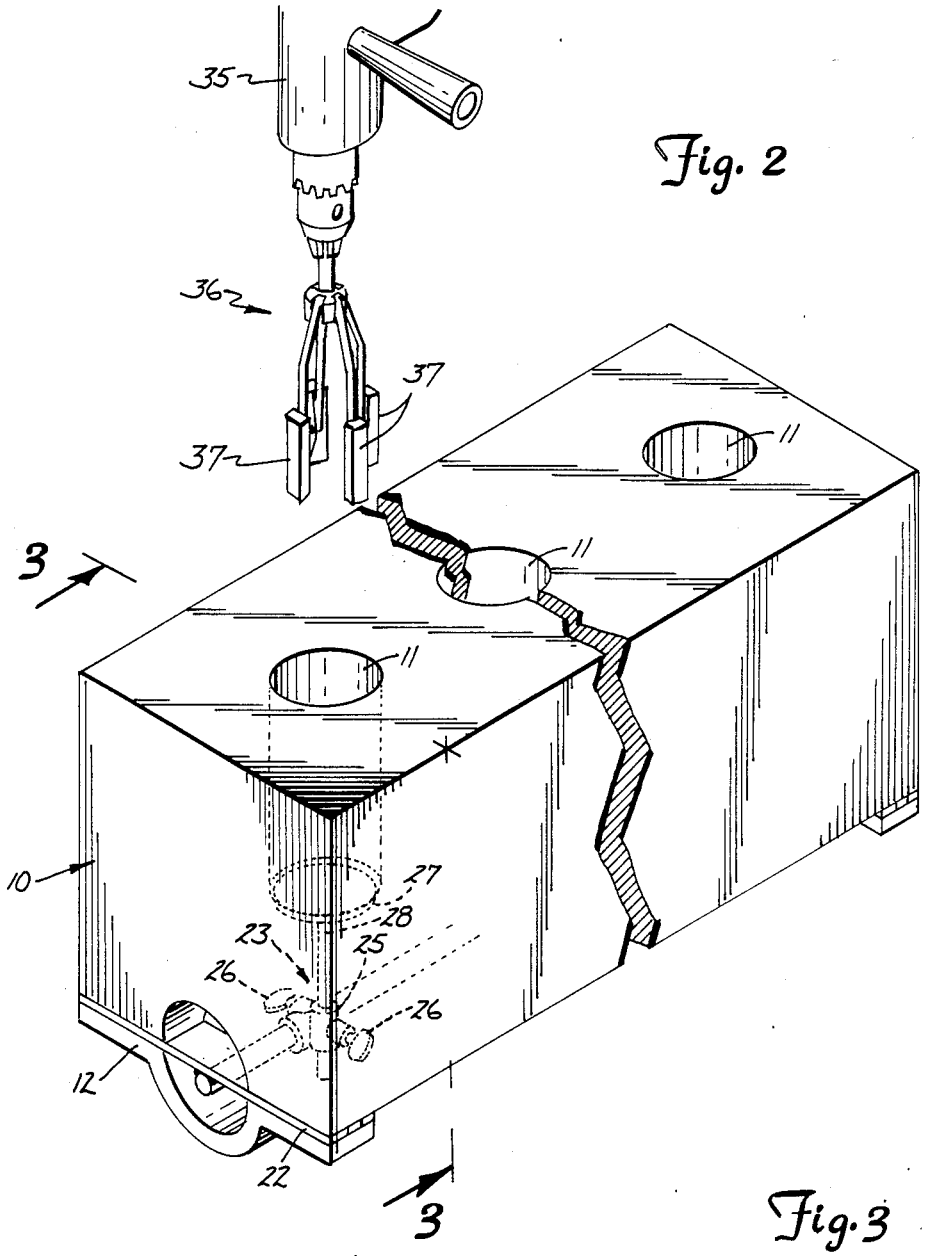
FIG. 2 is a perspective view of the engine block of FIG. 1 (shown somewhat schematically), the block being inverted with respect to FIG. 1.

In FIG. 2 the hone stop assembly (20) of the invention has been attached to the cylinder block (10), and the block has been inverted (with respect to FIG. 1) to allow the mechanic to proceed with the cylinder honing operation. The mechanic typically uses a conventional hand-held electric drill (35) carrying a suitable honing tool (36), glaze breaker, or similar device. The honing tool (36) in the drawing includes four honing stones (37).

Figure 3:
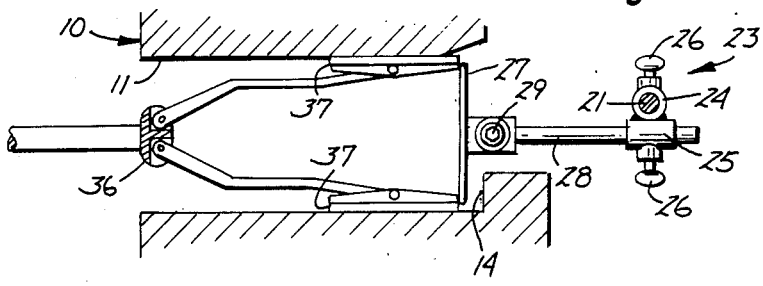
FIG. 3 is a partial cross-section of FIG. 2 taken along line 3—3 thereof, showing the honing tool inserted into the cylinder bore.

FIG. 3 shows a cross-section of the engine block revealing a metal casting or protrusion (14) extending into the area closely adjacent the end of the cylinder bore (11). The location, size, and number of such protrusions (14) will vary from engine to engine, but they are frequently encountered within the range of about one-half inch to two inches beyond the end of at least some of the cylinders of an engine. The adjustment means (23) provides a sufficient range of motion to allow the hone stop disk (27) to be conveniently and quickly positioned adjacent the end of a cylinder bore (11) between a protrusion (14) and the end of the cylinder bore (11).

In use, a mechanic will prepare an engine block (10) for reconditioning of the cylinder bore walls (11) by mounting the engine block (10) on an engine block stand and removing various parts to expose both ends of the cylinders. After removal of the crankshaft, the hone stop assembly (20) may be mounted to the engine block (10), preferably by attaching the anchoring straps (22) with the end crankshaft cap screws (13). The hone stop disk (27) is then positioned, by manipulation of the adjustment means (23), adjacent to the end of one of the cylinder bores (11). More specifically, the hone stop disk (27) is interposed between the end of the cylinder bore (11) and any engine block castings or protrusions (14) in close proximity thereto.

The mechanic may then proceed to use a honing tool (36), carried by a suitable hand-held electric drill (35). The mechanic inserts the stones (37) of the honing tool (36) into the cylinder, and then proceeds to hone the cylinder walls (11) with a regular in-and-out movement. When the honing stones (37) are inserted to the full depth of the cylinder (11) they will gently abut the hone stop disk (27), and the mechanic will then know that the stones (37) have reached the end of the cylinder (11). The mechanic does not need to be overly cautious about cracking or breaking the honing stones (37) on protrusions (14), and therefore can concentrate on obtaining a regular, even, reconditioning job, avoiding any taper to the cylinder bore (11) which normally accompanies such a procedure in the absence of use of the present invention.

The hone stop assembly (20) may be manufactured by well-known techniques. The device shown in the drawings may be fabricated from readily available steel stock and welded or otherwise fastened together where appropriate. Other suitable materials might also be employed including aluminum, fiberglass, or any of a variety of tough plastics, so long as the over-all structural strength of the device is sufficient to support the hone stop disk (27) appropriately. Similarly, other suitable frames, including the longitudinal shaft (21) and the anchoring straps (22), may be fabricated which would fulfill the function of the present frame to support the hone stop disk (27) at the appropriate locations. Alternate adjustment means (23) might also be provided to supply the requisite flexibility of orientation and positioning. Furthermore, in appropriate applications it may be desirable to include more than one hone stop disk (27) on a given frame.

While a preferred embodiment of the present invention has been described, it should be understood that various changes, adaptations and modifications may be made therein without departing from the spirit of the invention and the scope of the appended claims.

What is claimed is:

1. A hone stop assembly for use with a honing tool in honing the cylinder bores of an internal combustion engine block, the engine block being of the type having a plurality of cylinder bores having first and second ends and including a projection adjacent the first end of a first of said bores, said assembly comprising a frame mountable to the engine block; a hone stop; and adjustment means for adjustably securing the hone stop to the frame and allowing the hone stop to be selectively positioned proximal to the first end of said first cylinder bore interposed generally between the end of said cylinder bore and said projection to serve as a stop for the honing tool.

2. The assembly of claim 1 wherein the hone stop comprises a circular disk having an axis, and a hone stop shaft having a longitudinal axis, the shaft carrying the disk and being oriented normal to the plane of the disk coaxially therewith.

3. The assembly of claim 1 wherein the frame includes a longitudinal shaft oriented lengthwise of the engine block in juxtaposition with said first ends of said cylinder bores, the shaft carrying the adjustment means and allowing selective adjustment of the hone stop adjacent the first end of each of said cylinder bores without removing said frame from the engine block.

4. The assembly of claim 3 wherein the adjustment means comprises two perpendicular collars, a first of which ajustably receives therethrough the longitudinal frame shaft.

5. The assembly of claim 4 wherein the hone stop comprises a circular disk having an axis, and a hone stop shaft having a longitudinal axis, the shaft carrying the disk and being oriented normal to the plane of the disk coaxially therewith.

6. The assembly of claim 5 wherein the second collar adjustably receives therethrough the hone stop shaft.

7. The assembly of claim 4 wherein the first collar is adjustable both longitudinally and rotationally with respect to the longitudinal frame shaft, allowing the hone stop to be rotated away from a cylinder bore, moved longitudinally into juxtaposition with another cylinder bore, and rotated into a position proximal to the first end of said cylinder bore.

8. The assembly of claim 1 wherein the engine block is of the type having crankshaft cap bolts, and the assembly frame is attachable to the engine block by said crankshaft cap bolts.

9. A hone stop assembly for use with a honing tool in honing the cylinder bores of an internal combusion engine block, the engine block being of the type having a plurality of cylinder bores with first and second ends and including a projection adjacent the first end of at least a first of said bores, comprising:

a frame mountable to the engine block, the frame including a longitudinal shaft oriented lengthwise of the engine block in juxtaposition with the first ends of the cylinder bores;

a hone stop comprising a circular disk having an axis, and a hone stop shaft having a longitudinal axis, the shaft carrying the disk and being oriented normal to the plane of the disk coaxially therewith; and adjustment means for adjustably securing the hone stop to the frame and allowing the hone stop to be selectively positioned proximal to the first end of said first cylinder bore interposed generally between the end of said cylinder bore and said projection to serve as a stop for the honing tool, the adjustment means comprising two perpendicular collars, a first of which adjustably receives therethrough the longitudinal frame shaft, and the second of which adjustably receives therethrough the hone stop shaft, the first collar being adjustable both longitudinally and rotationally with respect to the longitudinal frame shaft, allowing the hone stop to be rotated away from a cylinder bore, moved longitudinally into juxtaposition with another cylinder bore, and rotated into a position proximal to the first end of said other cylinder bore.

10. A method of reconditioning the cylinder bores of an internal combustion engine block, the engine block being of the type having a plurality of cylinder bores with first and second ends, the block further including a projection adjacent the first end of at least one of said bores, comprising the steps of:

mounting a hone stop proximal to the first end of a cylinder bore and interposed generally between said first end of said cylinder bore and said projection;

inserting a cylinder honing tool through the second end of the cylinder bore; and honing the cylinder wall with the honing tool using a regular in-and-out axial movement, with respect to the bore axis, of the tool and allowing the tool to abut the hone stop at the end of said inward movement, said hone stop thereby preventing the honing tool from contacting the projection.

11. The method of claim 10 further comprising the steps of adjustably moving the hone stop from the first end of said cylinder bore to the first end of another cylinder bore, and then honing said other cylinder bore.

* * * * *